US007080970B2

(12) United States Patent
Horng et al.

(10) Patent No.: US 7,080,970 B2
(45) Date of Patent: Jul. 25, 2006

(54) HOUSING FOR AXIAL FLOW HEAT-DISSIPATING FAN

(75) Inventors: Alex Horng, Kaohsiung (TW); Mei-Chih Fang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 91 days.

(21) Appl. No.: 10/868,902

(22) Filed: Jun. 17, 2004

(65) Prior Publication Data

US 2005/0281665 A1 Dec. 22, 2005

(51) Int. Cl.
*F40D 29/60* (2006.01)

(52) U.S. Cl. ..... 415/213.1; 361/695

(58) Field of Classification Search ..... 415/186, 415/187, 208.3, 208.5, 211.1, 213.1, 220, 415/223; 361/695, 696, 697
See application file for complete search history.

(56) References Cited

U.S. PATENT DOCUMENTS 6,132,171 A 10/2000 Fujinaka et al.
6,293,753 B1 * 9/2001 Pal et al. ..... 415/221
6,710,486 B1 3/2004 Horng et al.

* cited by examiner

*Primary Examiner*—Edward K. Look
*Assistant Examiner*—Dwayne J White
(74) *Attorney, Agent, or Firm*—Bacon & Thomas, PLLC

(57) ABSTRACT

A housing for an axial flow heat-dissipating fan includes an annular wall including an air inlet in a first end thereof and an air outlet in a second end thereof. A motor of an axial flow heat-dissipating fan is received in the annular wall. A plurality of axially extending slits are defined in a circumference of the annular wall. At least two assembling sections are formed on the circumference of the annular and spaced from each other. One of the at least two assembling sections of the housing is engaged with one of at least two assembling sections of a similarly constructed housing.

19 Claims, 5 Drawing Sheets

HOUSING FOR AXIAL FLOW HEAT-DISSIPATING FAN

BACKGROUND OF THE INVENTION

1. Field of the Invention

The present invention relates to a housing for an axial flow heat-dissipating fan. In particular, the present invention relates to a housing for an axial flow heat-dissipating fan for increasing an inlet amount of air and for providing a reinforced structure.

2. Description of Related Art

U.S. Pat. No. 6,132,171 discloses a blower that sucks air inside a wall through radial slits as a fan rotates. The wall is formed away from ends of fan blades. Outer peripheral sections of the wall are planar and substantially flush with a rectangular casing body at a middle of upper, lower, right, and left sides of the body. The radial slits are formed in the wall for increasing the air inlet amount. A plurality of annular plates are spaced from each other and stacked in a direction along an axis of rotation of the fan to form the wall with radial slits. Spacers forming and supporting the slits are arranged toward the middle of each of the four sides of the casing body and located on the outer peripheral sections.

When mounted in a personal computer housing for dissipating heat, several blowers may be connected in parallel. In this case, a planar outer peripheral section of one of the blowers is in contact with and thus engaged with an associated peripheral section of another blower. Airflow passing through the radial slits of one of the blowers interferes with airflow passing through the radial slits of another blower, causing turbulences. Further, the spacers include portions projected outwardly from the wall, which protruded portions result in unstable contact and unstable connection between two adjacent planar peripheral sections respectively of two adjacent blowers.

U.S. Pat. No. 6,710,486 discloses a housing structure for a heat-dissipating fan. The housing structure comprises a housing, a plurality of axial guide blades, and a rotor. A radial air inlet is formed between two adjacent axial guide blades for increasing the inlet air amount. When the rotor is rotated, major airflow is sucked through an air inlet into the housing. Also, blades of the rotor change airflow sucked through the radial air inlets from radial direction to the axial direction of the housing. Due to the additional airflow, airflow between the upstream and the downstream of the blades can be balanced and air noise is lowered. However, reliable connection between two heat-dissipating fans of this type is impossible, as the axial guide blades of the heat-dissipating fan provide no structure for such connection.

OBJECTS OF THE INVENTION

An object of the present invention is to provide a housing for an axial flow heat-dissipating fan with improved assembling stability.

Another object of the present invention is to provide a housing for an axial flow heat-dissipating fan with improved assembling flexibility.

A further object of the present invention is to provide a housing for an axial flow heat-dissipating fan with increased air inlet amount.

Still another object of the present invention is to provide a housing for an axial flow heat-dissipating fan with lowered blowing noise.

SUMMARY OF THE INVENTION

In accordance with an aspect of the present invention, a housing for an axial flow heat-dissipating fan comprises an annular wall including an air inlet in a first end thereof and an air outlet in a second end thereof. A motor of an axial flow heat-dissipating fan is received in the annular wall. A plurality of axially extending slits are defined in a circumference of the annular wall. At least two assembling sections are formed on the circumference of the annular and spaced from each other. One of the at least two assembling sections of the housing is engaged with one of at least two assembling sections of a similarly constructed housing.

Each axially extending slit may be inclined according to a blowing direction of the fan motor. The assembling sections are spaced from each other by 90 degrees or 180 degrees.

In an embodiment of the invention, at least one of the axially extending slits includes an end extending through an end face of the first end of the annular wall and communicated with the air inlet. The annular wall further includes a reinforcing rib extending along the circumference of the annular wall and across the axially extending slits to reinforce structure of the annular wall.

Two of the axially extending slits adjacent to each other may be communicated with each other, forming a slit with an enlarged end to increase air intake efficiency in an axial direction and to increase air intake efficiency in a radial direction. The enlarged end of the slit extends through an end face of the first end of the annular wall and is communicated with the air inlet.

In another embodiment of the invention, the annular wall further includes at least one engaging plate extending radially outward from the first end that defines the air inlet. Further, the annular wall further includes at least one engaging plate extending radially outward from the second end that defines the air outlet. The engaging plate includes at least one side that is coplanar with an associated assembling section. Each axially extending slit includes an outer end and an inner end narrower than the outer end, providing a pressurizing effect while drawing air through the axially extending slits.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
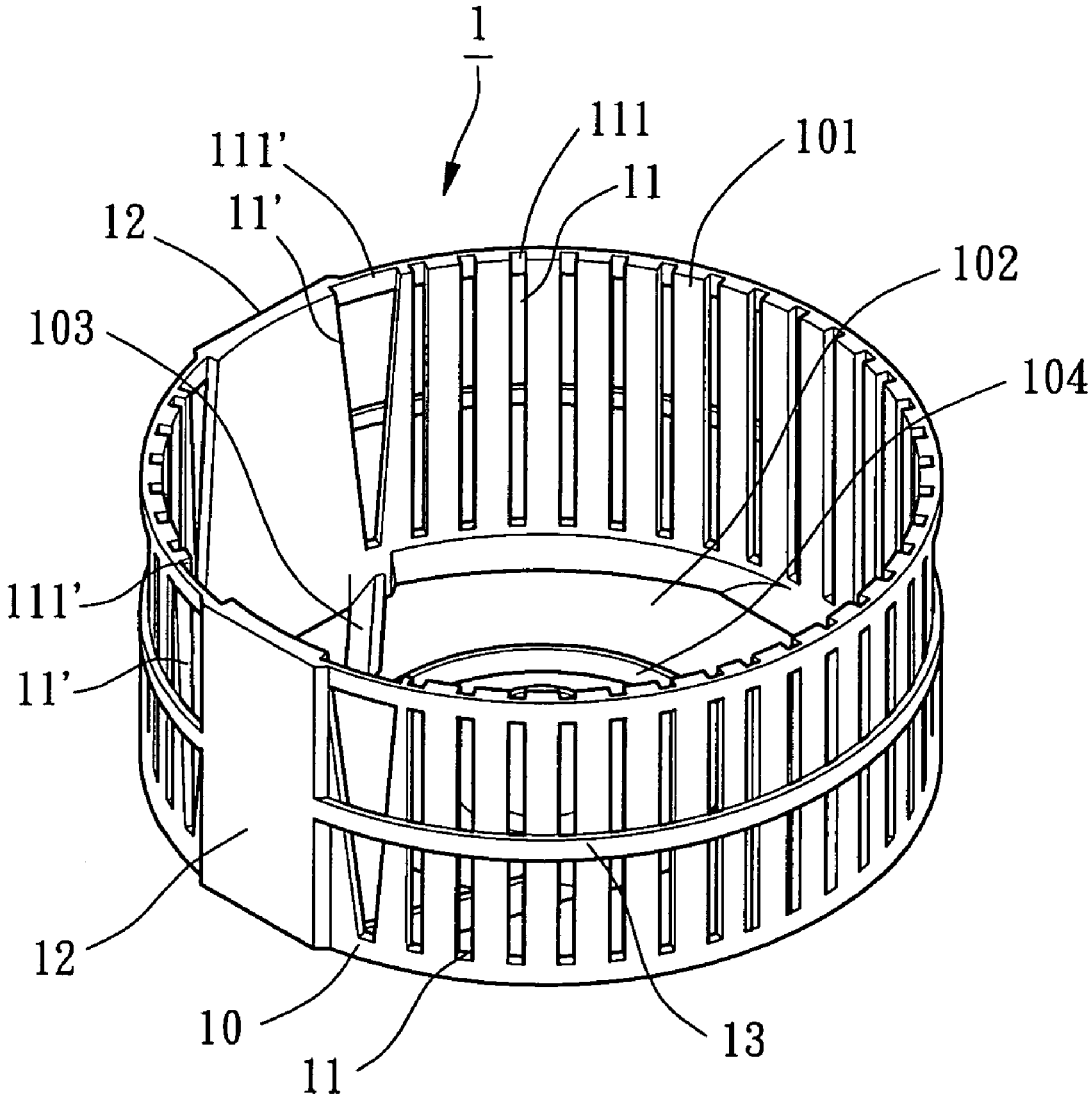
FIG. 1 is a perspective view of a first embodiment of a housing for an axial flow heat-dissipating fan in accordance with the present invention.
Figure 2:
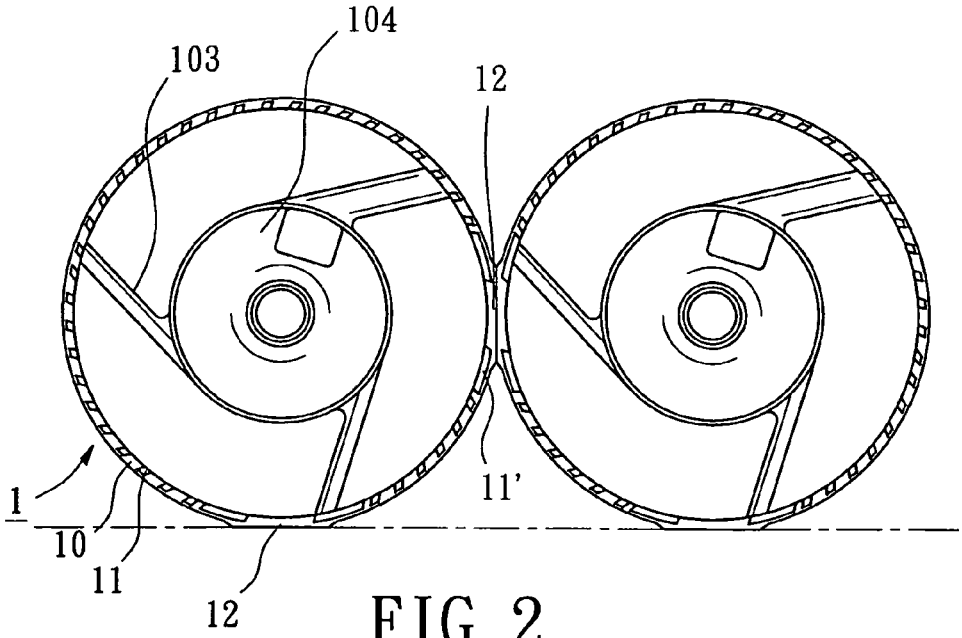
FIG. 2 is a sectional view illustrating connection of two housings in FIG. 1.

FIG. 1 is a perspective view of a first embodiment of a housing for an axial flow heat-dissipating fan in accordance with the present invention. FIG. 2 is a sectional view illustrating connection of two housings in FIG. 1.

The housing 1 for an axial flow heat-dissipating fan in accordance with the present invention comprises an annular wall 10 that is substantially circular when viewed in section. The annular wall 10 includes an air inlet 101 in an end thereof and an air outlet 102 in the other end thereof. A base 104 is mounted in the air outlet 102 and supported by a plurality of ribs 103 between the base 104 and the annular wall 10. The annular wall 10 further includes a plurality of axially extending slits 11 equispaced along a circumference of the annular wall 10 for drawing ambient air surrounding the annular wall 10. Each axially extending slit 11 includes an end 111 extending through an end face of the annular wall 10 and communicated with the air inlet 101. In an embodiment, each axially extending slit 11 may be inclined according to the blowing direction of a rotor (not shown) of a motor (not shown) of the axial flow heat-dissipating fan mounted in the annular wall 10.

The annular wall 10 further includes two assembling sections 12 that are spaced by, e.g., 90 degrees. Each assembling section 12 is planar without any slit or opening. Further, a reinforcing rib 13 extends along the circumference of the annular wall 10 and across the axially extending slits 11. The reinforcing rib 13 reinforces the structure of the annular wall 10 with axially extending slits 11.

Two of the axially extending slits 11 adjacent to each other may be communicated with each other (see triangular slits 11' with an enlarged end 111' communicated with the air inlet 101). Thus, the air inlet efficiency in the axial direction and the air inlet efficiency in the radial direction are both improved without adversely affecting the structural strength of the annular wall 10.

As illustrated in FIG. 1, when a single housing 1 is used, air is drawn into the housing 1 via the air inlet 101 and the axially extending slits 11 and 11' when the motor of the heat-dissipating fan turns. The airflow from the air inlet 101 and the airflow from the axially extending slits 11 and 11' merge with each other and flow toward the air outlet 102. By such an arrangement, the overall air inlet amount is increased, generation of turbulent is avoided, and the wind noise of the incoming air is reduced.

As illustrated in FIG. 2, when two housings 1 are connected in parallel (i.e., disposed side by side), an assembling section 12 of one of the housings 1 is in contact with and securely connected to an assembling section 12 of the other housing 1. Since the assembling sections 12 are planar and have a relatively wide area without any slit or opening, a sufficiently strong engagement between the housings 1 is provided without adversely affecting the air inlet effects of the housings 1 and without generation of turbulent. Namely, the air intake operations of the housings 1 would not interfere with each other, and no wind noise would be incurred accordingly. The other assembling section 12 of each housing 1 can be fixed to an appropriate position in, e.g., a computer housing. Accordingly, the air inlet amount is increased, the assembling reliability is improved, the wind noise resulting from the intake of air and from mutual interference of intake operations is avoided, and the assembling flexibility is improved.

Figure 3:
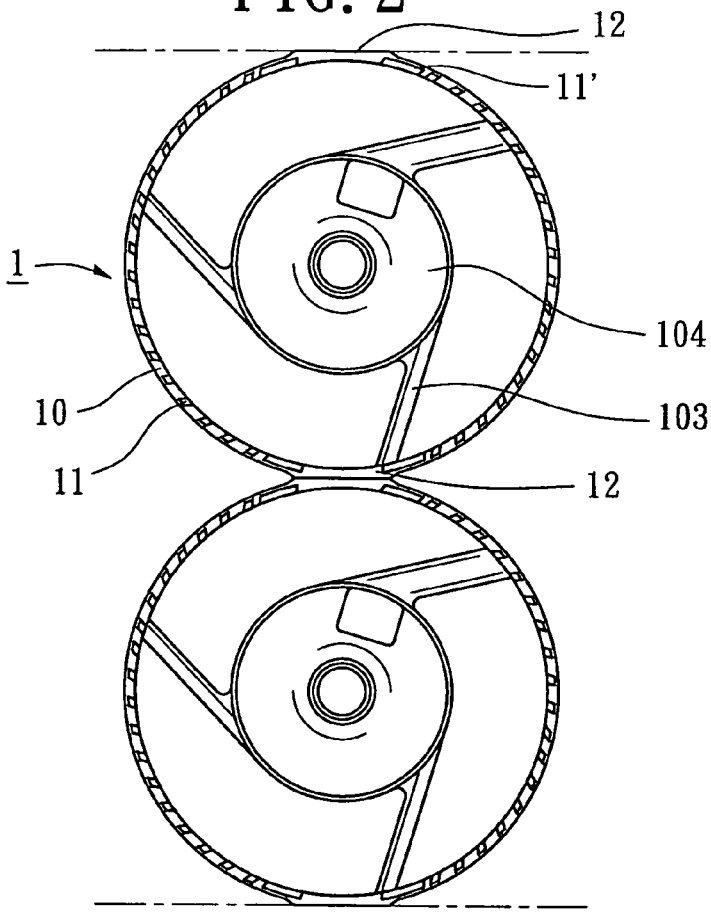
FIG. 3 is a sectional view illustrating connection of two housings of a modified embodiment in accordance with the present invention.

FIG. 3 is a sectional view illustrating connection of two housings 1 of a modified embodiment in accordance with the present invention. In this embodiment, the annular wall 10 of each housing 1 includes two assembling sections 12 that are spaced by 180 degrees, allowing different connection of the housings 1. An assembling section 12 of one of the housings 1 is in contact with and securely connected to an assembling section 12 of the other housing 1. Since the assembling sections 12 are planar and have a relatively wide area without any slit or opening, a sufficiently strong engagement between the housings 1 is provided without adversely affecting the air inlet effects of the housings 1 and without generation of turbulent. Namely, the air intake operations of the housings 1 would not interfere with each other, and no wind noise would be incurred accordingly. The other assembling section 12 of each housing 1 can be fixed to an appropriate position in, e.g., a computer housing. Accordingly, the air inlet amount is increased, the assembling reliability is improved, the wind noise resulting from the intake of air and from mutual interference of intake operations is avoided, and the assembling flexibility is improved. More housings 1 can be connected one by one to meet different needs.

Figure 4:
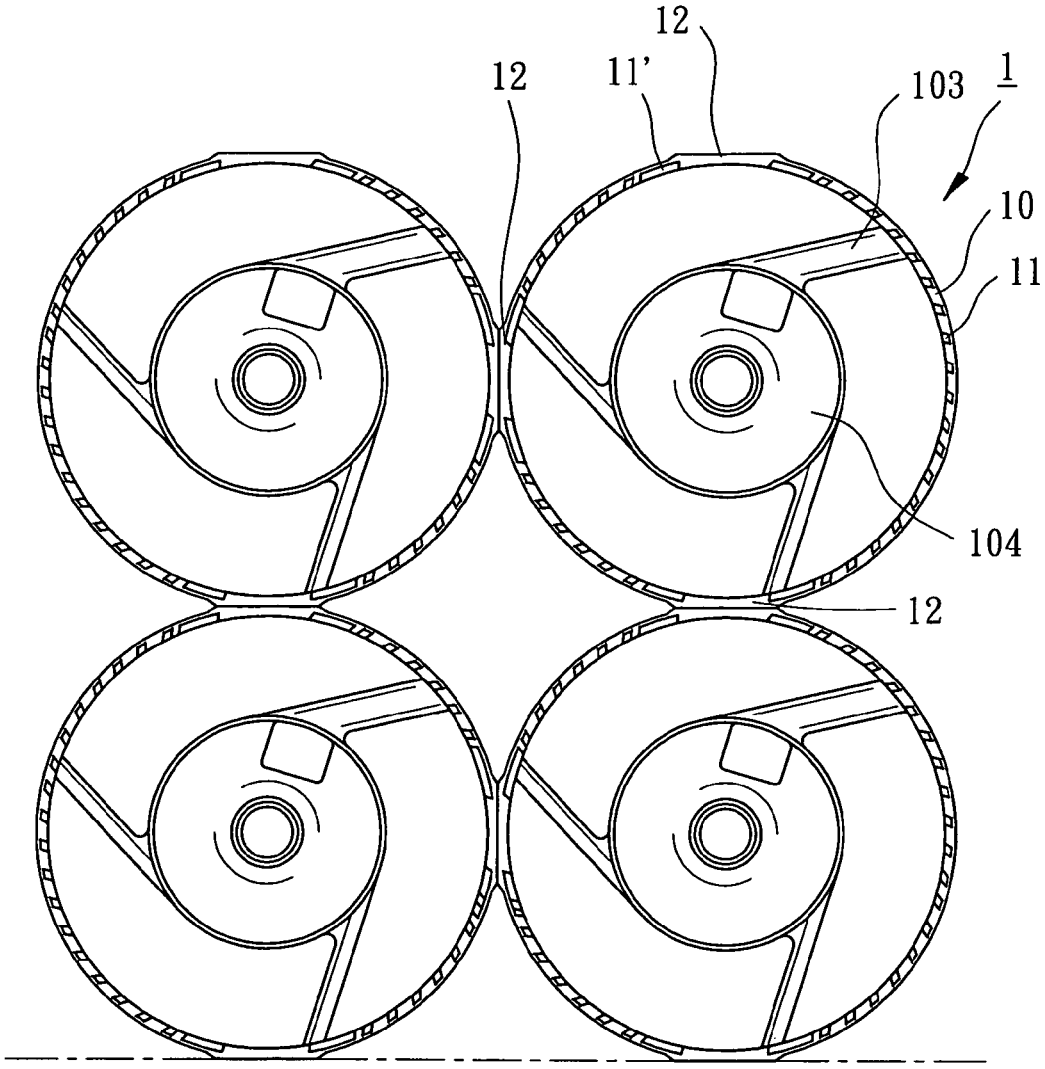
FIG. 4 is a sectional view illustrating connection of four housings of another modified embodiment in accordance with the present invention.

FIG. 4 is a sectional view illustrating connection of four housings of another modified embodiment in accordance with the present invention. In this embodiment, the annular wall 10 of each housing 1 includes three assembling sections 12 that are spaced by 90 degrees, allowing different connection of the housings 1. Two assembling sections 12 of each housing 1 are in contact with and securely connected to two assembling sections 12 of two other housings 1. Since the assembling sections 12 are planar and have a relatively wide area without any slit or opening, a sufficiently strong engagement between the housings 1 is provided without adversely affecting the air inlet effects of the housings 1 and without generation of turbulent. Namely, the air intake operations of the housings 1 would not interfere with one another, and no wind noise would be incurred accordingly. The remaining assembling section 12 of each housing 1 can be fixed to an appropriate position in, e.g., a computer housing. Accordingly, the air inlet amount is increased, the assembling reliability is improved, the wind noise resulting from the intake of air and from mutual interference of intake operations is avoided, and the assembling flexibility is improved. More housings 1 can be connected in this way to meet different needs.

Figure 5:
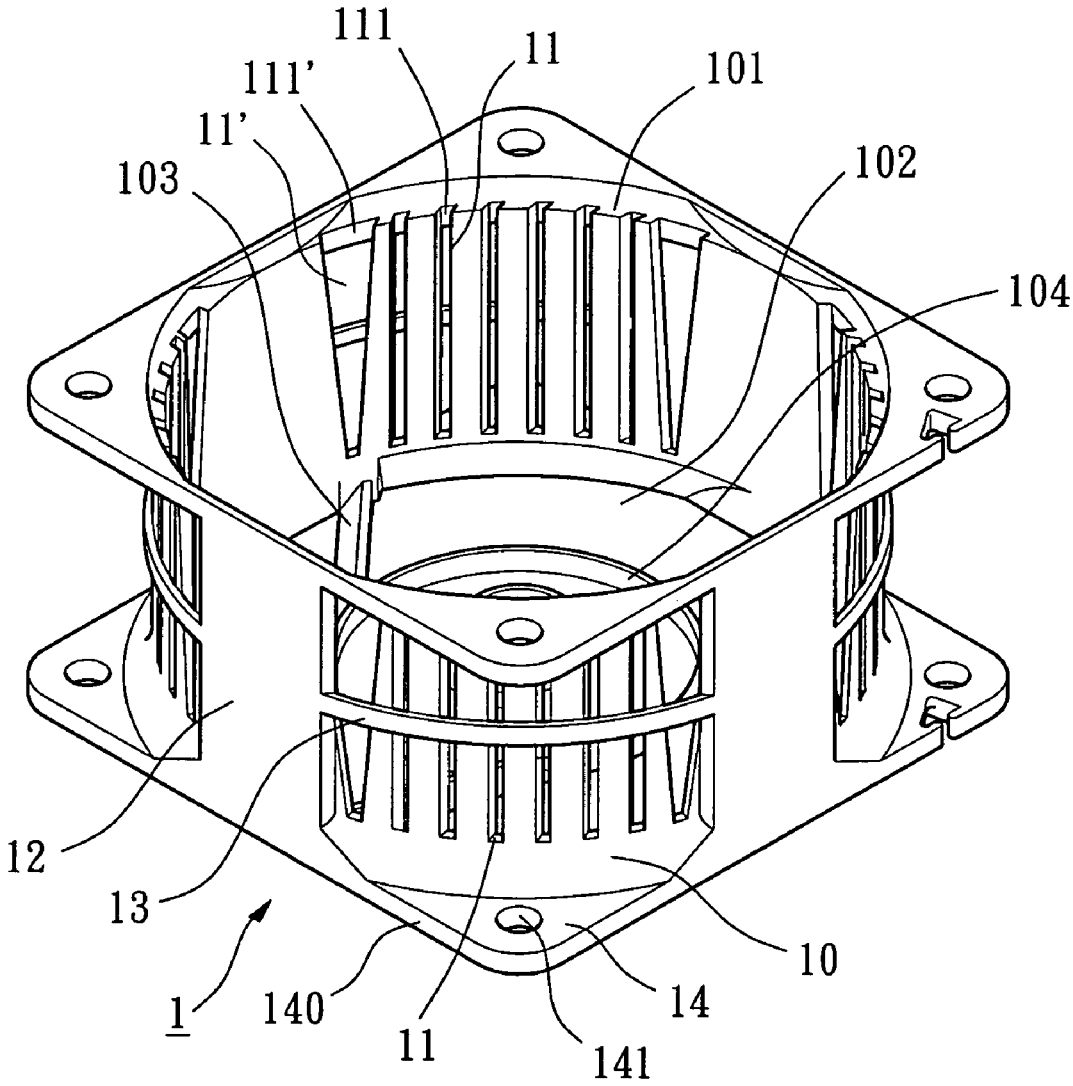
FIG. 5 is a perspective view of a further modified embodiment of the housing in accordance with the present invention.
Figure 6:
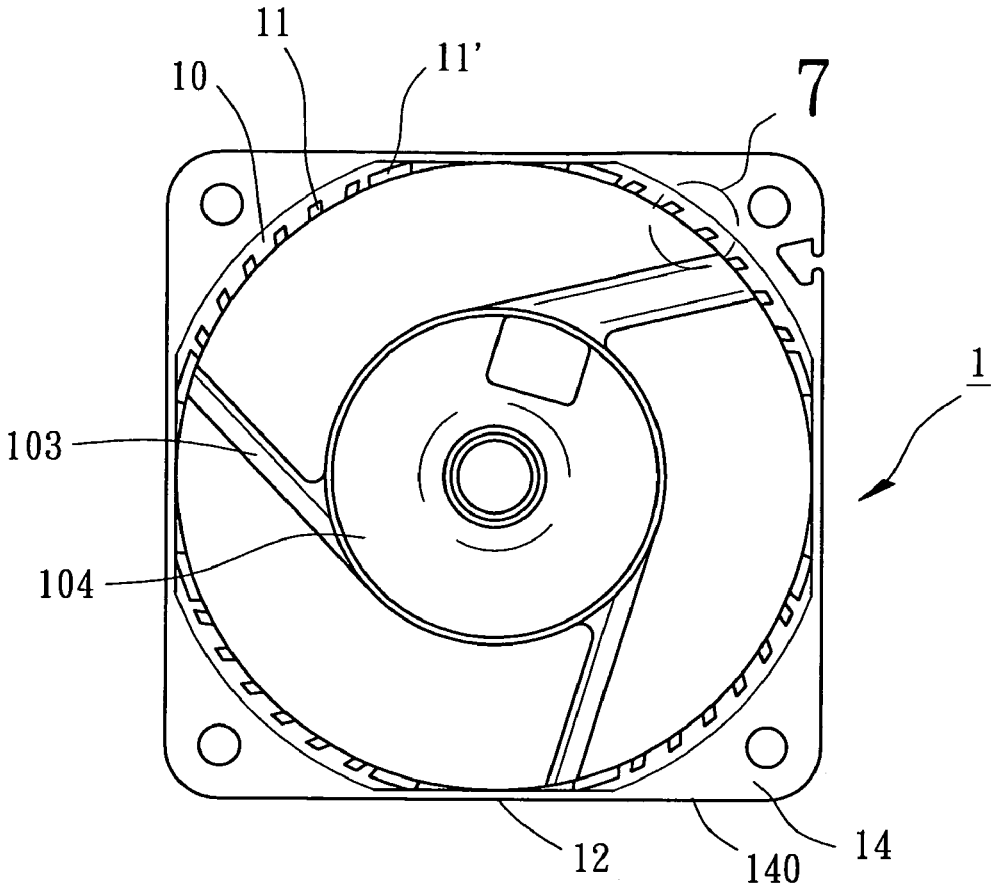
FIG. 6 is a top view of the housing in FIG. 5.
Figure 7:
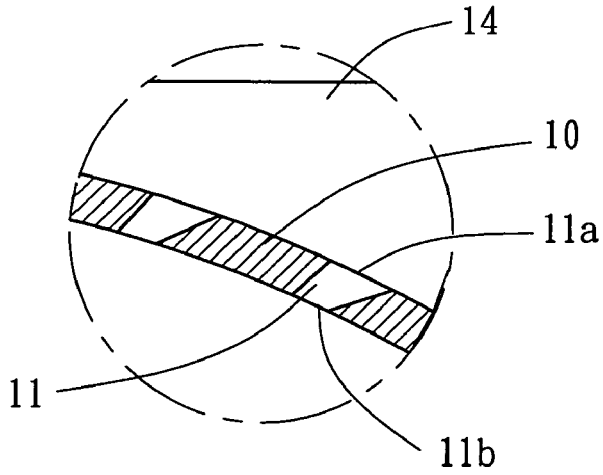
FIG. 7 is an enlarged view of a circled portion in FIG. 6.

FIG. 5 is a perspective view of a further modified embodiment of the housing in accordance with the present invention. FIG. 6 is a top view of the housing in FIG. 5. FIG. 7 is an enlarged view of a circled portion in FIG. 6. In this embodiment, the annular wall 10 of each housing 1 includes four assembling sections 12 that are spaced by 90 degrees, allowing different connection of the housings 1. Further, the annular wall 10 includes four engaging plates 140 extending radially outward from the end defining the air inlet 101. Similarly, the annular wall 10 includes four engaging plates 14 extending radially outward from the other end defining the air outlet 102. Each engaging plate 14 includes a fixing hole 141 to allow the housing 1 to be fixed in the axial direction. Preferably, each engaging plate 14 includes two edges 140 that are coplanar with two of the assembling sections 12. The assembling sections 12 and the edges 140 provide an increased engaging area for two housings 1 connected to each other. Further, the assembling sections 12 and the edges 140 provide a larger area, allowing easy fixing of the housing 1 to an appropriate position.

Referring to FIG. 7, each axially extending slit 11 includes an outer end 11*a* and an inner end 11*b* narrower than the outer end 11*a* to provide a pressurizing effect while drawing air into the housing 1 via the axially extending slit 11 without adversely affecting the strength of the annular wall 10. Also, each axially extending slit 11 may be inclined according to the blowing direction of the rotor.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A housing for an axial flow heat-dissipating fan, comprising:

an annular wall including an air inlet in a first end thereof and an air outlet in a second end thereof, the annular wall being adapted to receive a motor of an axial flow heat-dissipating fan;

a plurality of axially extending slits defined in a circumference of the annular wall; and at least one assembling section formed on the circumference of the annular wall;

said assembling section of the housing being engaged with one assembling section of a similarly constructed housing or fixed to an appropriate position, wherein at least one of the axially extending slits includes an end extending through an end face of the first end of the annular wall and communicated with the air inlet.

2. The housing for an axial flow heat-dissipating fan as claimed in claim 1, wherein each said axially extending slit is inclined according to a blowing direction of the fan motor.

3. The housing for an axial flow heat-dissipating fan as claimed in claim 1, wherein the housing includes at least two assembling sections formed on the circumference, and said at least two assembling sections are spaced apart from each other by one of 90 degrees and 180 degrees.

4. The housing for an axial flow heat-dissipating fan as claimed in claim 1, wherein each of said axially extending slit includes an outer end and an inner end narrower than the outer end, providing a pressurizing effect while drawing air through the axially extending slits.

5. The housing for an axial flow heat-dissipating fan as claimed in claim 1, wherein the annular wall further includes at least one engaging plate extending radially outward from the first end that defines the air inlet.

6. The housing for an axial flow heat-dissipating fan as claimed in claim 5, wherein at least one engaging plate includes at least one side that is coplanar with assembling section.

7. The housing for an axial flow heat-dissipating fan as claimed in claim 6, wherein each of said axially extending slit includes an outer end and an inner end narrower than the outer end, providing a pressurizing effect while drawing air through the axially extending slits.

8. The housing for an axial flow heat-dissipating fan as claimed in claim 5, wherein the annular wall further includes at least one engaging plate extending radially outward from the second end that defines the air outlet.

9. The housing for an axial flow heat-dissipating fan as claimed in claim 8, wherein at least one engaging plate includes at least one side that is coplanar with assembling section.

10. The housing for an axial flow heat-dissipating fan as claimed in claim 9, wherein each of said axially extending slit includes an outer end and an inner end narrower than the outer end, providing a pressurizing effect while drawing air through the axially extending slits.

11. The housing for an axial flow heat-dissipating fan as claimed in claim 8, wherein each of said axially extending slit includes an outer end and an inner end narrower than the outer end, providing a pressurizing effect while drawing air through the axially extending slits.

12. The housing for an axial flow heat-dissipating fan as claimed in claim 5, wherein each of said axially extending slit includes an outer end and an inner end narrower than the outer end, providing a pressurizing effect while drawing air through the axially extending slits.

13. The housing for an axial flow heat-dissipating fan as claimed in claim 1, wherein the annular wall further includes at least one engaging plate extending radially outward from the second end that defines the air outlet.

14. The housing for an axial flow heat-dissipating fan as claimed in claim 13, wherein each of said axially extending slit includes an outer end and an inner end narrower than the outer end, providing a pressurizing effect while drawing air through the axially extending slits.

15. The housing for an axial flow heat-dissipating fan as claimed in claim 13, wherein at least one engaging plate includes at least one side that is coplanar with assembling section.

16. The housing for an axial flow heat-dissipating fan as claimed in claim 15, wherein each of said axially extending slit includes an outer end and an inner end narrower than the outer end, providing a pressurizing effect while drawing air through the axially extending slits.

17. A housing for an axial flow heat-dissipating fan, comprising:

an annular wall including an air inlet in a first end thereof and an air outlet in a second end thereof, the annular wall being adapted to receive a motor of an axial flow heat-dissipating fan;

a plurality of axially extending slits defined in a circumference of the annular wall: and at least one assembling section formed on the circumference of the annular wall:

said assembling section of the housing being fixed to an appropriate position, wherein the annular wall further includes a reinforcing rib extending along the circumference of the annular wall and across the axially extending slits to reinforce structure of the annular wall.

18. A housing for an axial flow heat-dissipating fan, comprising;

an annular wall including an air inlet in a first end thereof and an air outlet in a second end thereof, the annular wall being adapted to receive a motor of an axial flow heat-dissipating fan;

a plurality of axially extending slits defined in a circumference of the annular wall; and at least one assembling section formed on the circumference of the annular wall;

said assembling section of the housing being fixed to an appropriate position, wherein two of the axially extending slits adjacent to each other are communicated with each other, forming a slit with an enlarged end to increase air intake efficiency in an axial direction and to increase air intake efficiency in a radial direction.

19. The housing for an axial flow heat-dissipating fan as claimed in claim 18, wherein the enlarged end of the slit extends through an end face of the first end of the annular wall and is communicated with the air inlet.

* * * * *